US005655867A

United States Patent [19]

Gysi et al.

[11] Patent Number: 5,655,867

[45] Date of Patent: Aug. 12, 1997

[54] PROCESS FOR FEEDING CAN BODIES TO A CAN WELDING STATION AND A DEVICE FOR CARRYING OUT THE PROCESS

[75] Inventors: Peter Gysi, Bellikon; Gideon Levy, Orselina, both of Switzerland

[73] Assignee: Elpatronic AG, Zug, Switzerland

[21] Appl. No.: 588,562

[22] Filed: Jan. 18, 1996

Related U.S. Application Data

[62] Division of Ser. No. 84,359, Jun. 28, 1993, abandoned.

[51] Int. Cl.[6] ..... B21D 51/26

[52] U.S. Cl. ..... 413/1; 413/72; 413/75; 413/76

[58] Field of Search ..... 413/1, 71–76; 219/64; 198/478.1, 482.1, 470.1

[56] References Cited

U.S. PATENT DOCUMENTS 783,788 2/1905 Johnson .
971,278 9/1910 Johnson .
1,639,512 8/1927 Lange .
2,135,579 11/1938 Johnson .
2,259,914 10/1941 Weisenburg .
3,100,470 8/1963 Wolfe .

FOREIGN PATENT DOCUMENTS 770364 3/1957 United Kingdom .

*Primary Examiner*—Jack W. Lavinder
*Attorney, Agent, or Firm*—McCormick, Paulding & Huber

[57] ABSTRACT

Two destacking tables and two can body forming stations are provided, the latter forming cylindrical can bodies from the metal sheets stacked on the destacking tables. These can bodies are subsequently conveyed along the feed axis to the welding station, which welds the longitudinal seam of the can bodies. The provision of two destacking tables and two can body forming stations enables these elements to operate at the cycle rate of the welding station. This permits welding to be effected with an increased cycle rate, with reliable feeding of the can bodies despite this.

16 Claims, 10 Drawing Sheets

PROCESS FOR FEEDING CAN BODIES TO A CAN WELDING STATION AND A DEVICE FOR CARRYING OUT THE PROCESS

This is a divisional of application Ser. No. 08/084,359 filed on Jun. 28, 1993 now abandoned.

BACKGROUND OF THE INVENTION

This invention relates to a process for feeding metal sheets formed into can bodies to a can welding station. The invention also relates to a device for carrying out the process.

As is known, during the manufacture of cans the metal sheets are drawn from a destacking table and fed to a rounding apparatus which forms the can bodies. The formed can body is then further conveyed to the welding station, where the longitudinal seam of the can is made. Progress in welding technology has enabled the forward feed during welding to be increased to up to 150 m/min. Within a range of forward feed rates such as this, the take-off of the metal sheets from the stacks and the forming of the can bodies pose problems, however.

The underlying object of the invention is therefore to create a feeding process for the can welding station which can be used even at high rates of forward feed and which operates reliably.

SUMMARY OF THE INVENTION

This object is achieved for a process of the type cited initially in that metal sheets are each conveyed from at least two destacking stations to at least two can forming stations, and that the formed can bodies are brought into a linear sequence for feeding to the welding station.

According to an alternative solution, this object is achieved for a process of the type cited initially in that metal sheets of twice the can body width are conveyed to two can body forming stations from a destacking station via a cutting device which cuts out metal sheets of single can body width from them, and that the formed can bodies are brought into a linear sequence for feeding to the welding station.

The use of two destacking stations or one destacking station with a cutting device, as well as two can forming stations, results in these feeder elements only having to operate at half the rate of the welding station. This makes it easier to design these feeder elements and increases their reliability. The desired high rate of operation is nevertheless achieved at the welding station.

BRIEF DESCRIPTION OF THE DRAWINGS

Embodiments of the invention are explained in more detail below with reference to the drawings, where.

DESCRIPTION OF THE PREFERRED EMBODIMENTS

Figure 1:
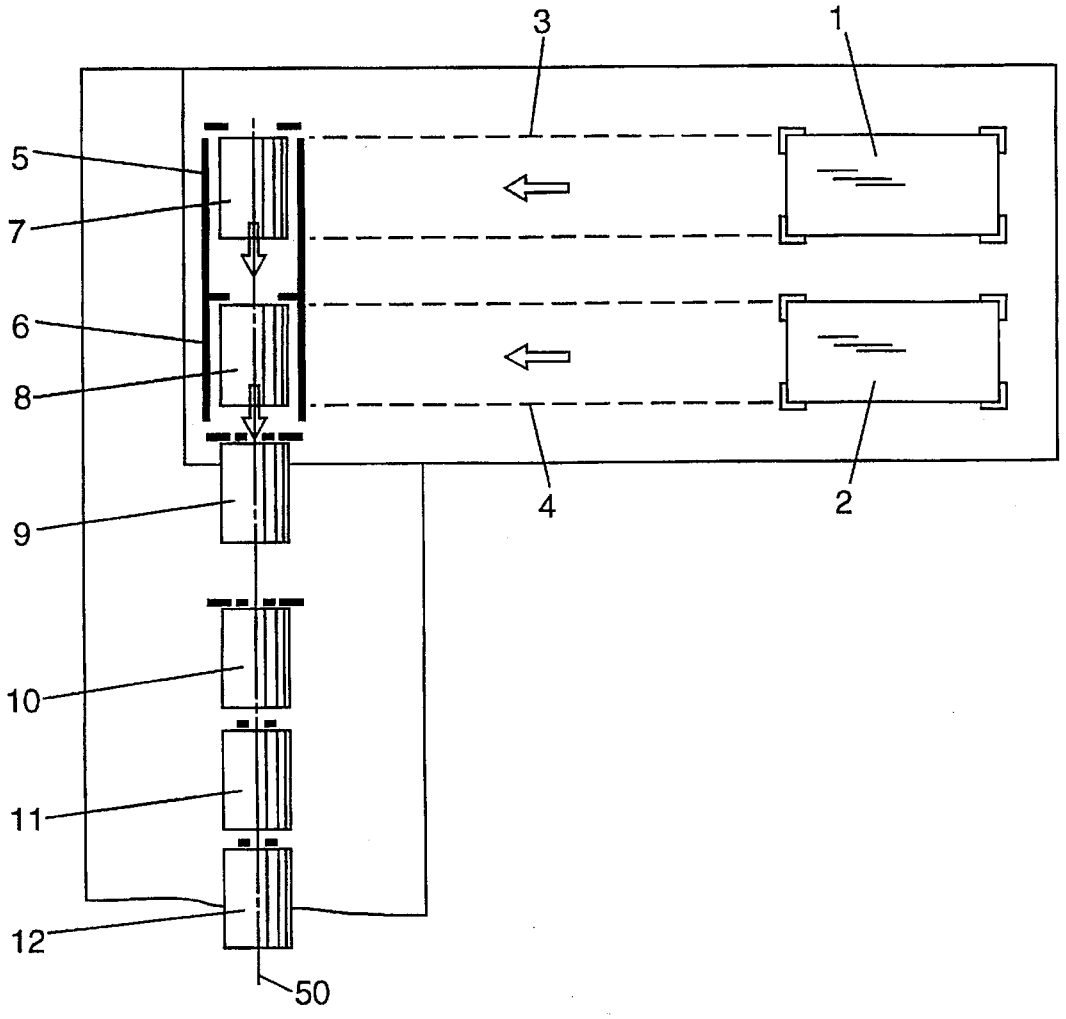
FIG. 1 illustrates a first embodiment with two destacking tables.

FIG. 1 is a schematic illustration of the feeder elements to a welding station (not shown) for welding can bodies. The feeder elements have a first destacking table 1 and a second destacking table 2. A stack of flat metal sheets is disposed on each destacking table 1,2. These metal sheets are individually taken from the stack on each table and are each conveyed via a conveying path 3,4 respectively to a can body forming station 5,6 respectively. In each body forming station a cylindrical can body is formed from the flat metal sheet. In the embodiment shown in FIG. 1, two can bodies 7,8; 9,10; 11,12 respectively are each formed simultaneously. After forming, the two can bodies are ejected from the body forming stations 5,6 which are situated in series on the feed axis. The can bodies thus already lie in a linear sequence on the feed axis of the welding station. After the ejection of the can bodies from the body forming stations, fresh metal sheets are introduced into the body forming stations from the destacking tables 1,2. It may be seen without further explanation that with this arrangement the destacking tables and the body forming stations can operate at half the cycle rate compared with the welding station, in order to make the required number of can bodies available. However, with this arrangement a greater conveyor stroke is necessary in order to eject the two formed can bodies from the two body forming stations.

Figure 2:
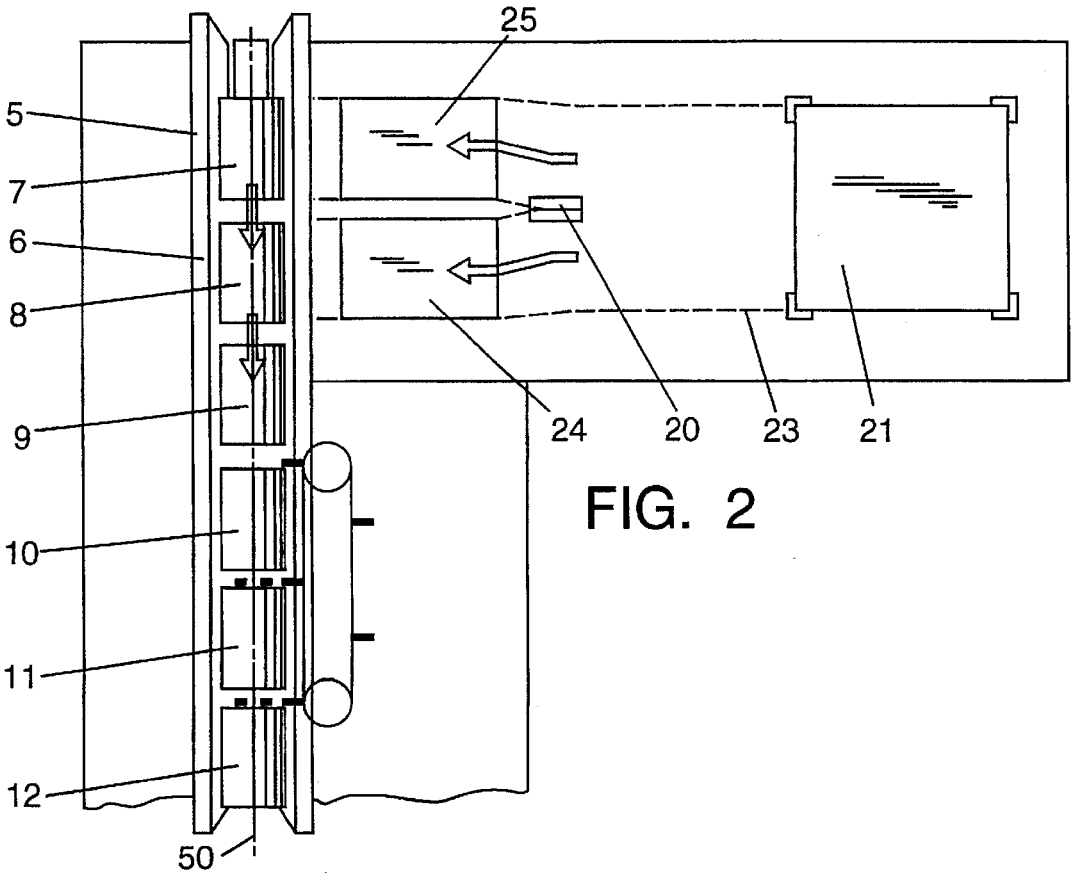
FIG. 2 illustrates an embodiment according to the alternative solution, with one destacking table.

FIG. 2 illustrates an alternative embodiment of the invention. In this embodiment a destacking table 21 is provided, on which a stack of metal sheets is disposed, however, the width of which is twice as great as the width of the metal sheets in the variant shown in FIG. 1. In FIG. 2, one metal sheet is withdrawn from the destacking table 21 each time and fed along the conveying path 23 to a cutting device 20. This cutting device 20 cuts two metal sheets of half the width from the said one metal sheet, and these two metal sheets are each conveyed along the conveying path 24,25 respectively to a can body forming station 5,6 respectively. The can bodies 7,8 are then again simultaneously formed in the two body forming stations and are thereafter ejected. This operation is thus the same as in the variant shown in FIG. 1. It also results in the same advantages.

Figure 3:
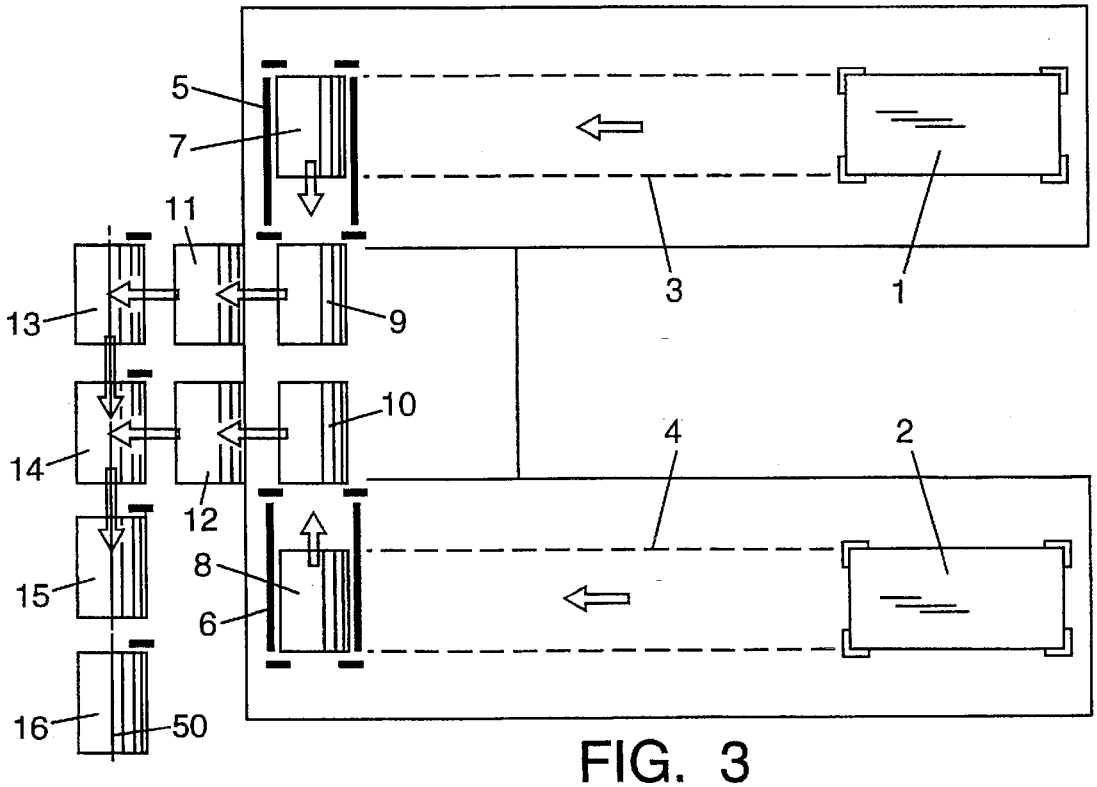
FIG. 3 illustrates another embodiment according to the first solution.

FIG. 3 illustrates an embodiment of the first variant of the solution, with two destacking tables. In FIG. 3, the same reference numerals as in FIG. 1 denote essentially the same elements. Two metal sheets are simultaneously introduced into two can body forming stations 5,6 in this embodiment also, and formed into a can body there. However, the body forming stations 5,6 here do not lie on the feed axis 50 to the welding station, but are parallel thereto. Moreover, the body forming stations eject the formed can bodies 7,8 into a region between the two body forming stations. The can bodies are then first displaced from this region in parallel, until they lie on the feed axis 50. In addition to the advantage of half the number of cycles, which has already been cited, the advantage of this arrangement is that it avoids the large conveying stroke for the can bodies which is necessary for ejection from the body forming stations according to FIG. 1. The transverse movement of the can bodies with respect to the feed axis 50 may be effected for example by means of a circulating belt which has individual compartments into which each of the formed can bodies from the body forming station can be inserted.

Figure 4:
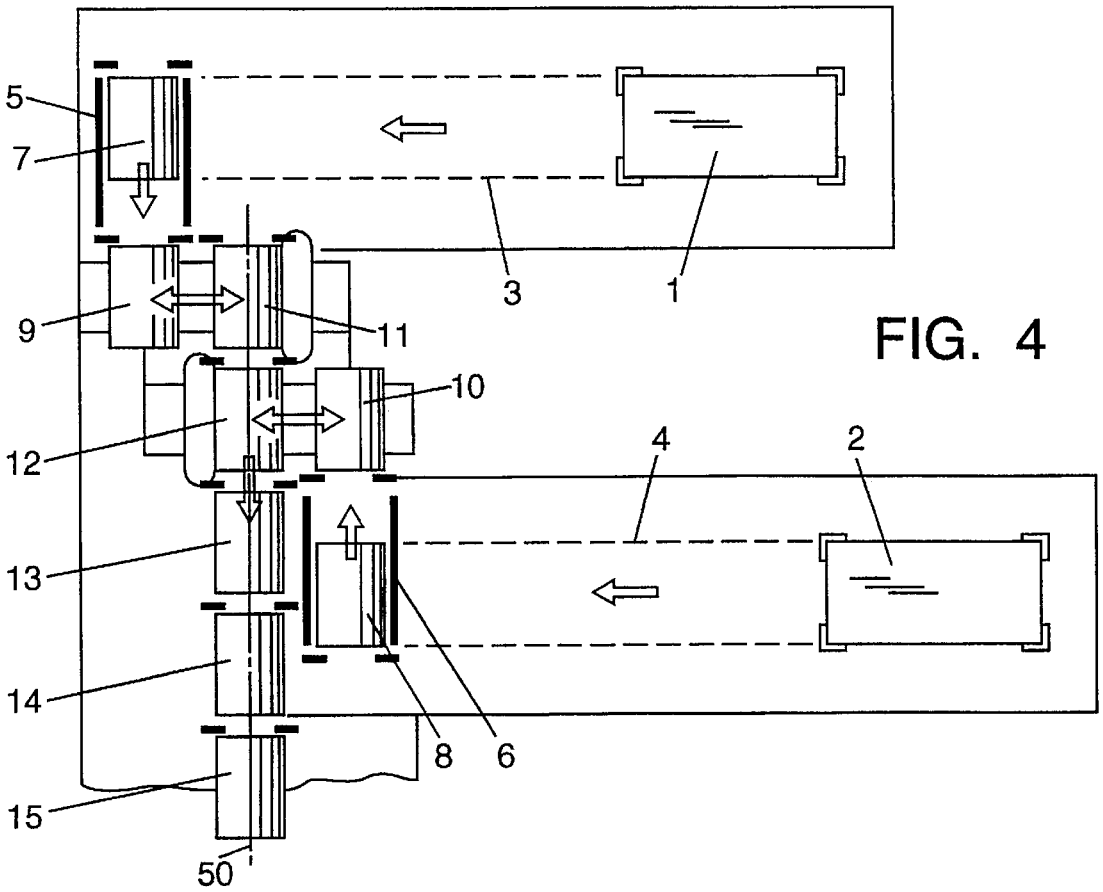
FIG. 4 illustrates another embodiment of the invention with two destacking tables.

FIG. 4 illustrates another embodiment, wherein the same reference numerals denote the same elements as before. In this embodiment the two can body forming stations 5,6 are disposed respectively on both sides of the feed axis 50. The finish-formed can bodies 7,8 respectively are each brought on to the feed axis 50 from opposite sides by means of a transverse displacement. This transverse displacement may again be effected by means of a circulating belt which has compartments for the can bodies.

Figure 5:
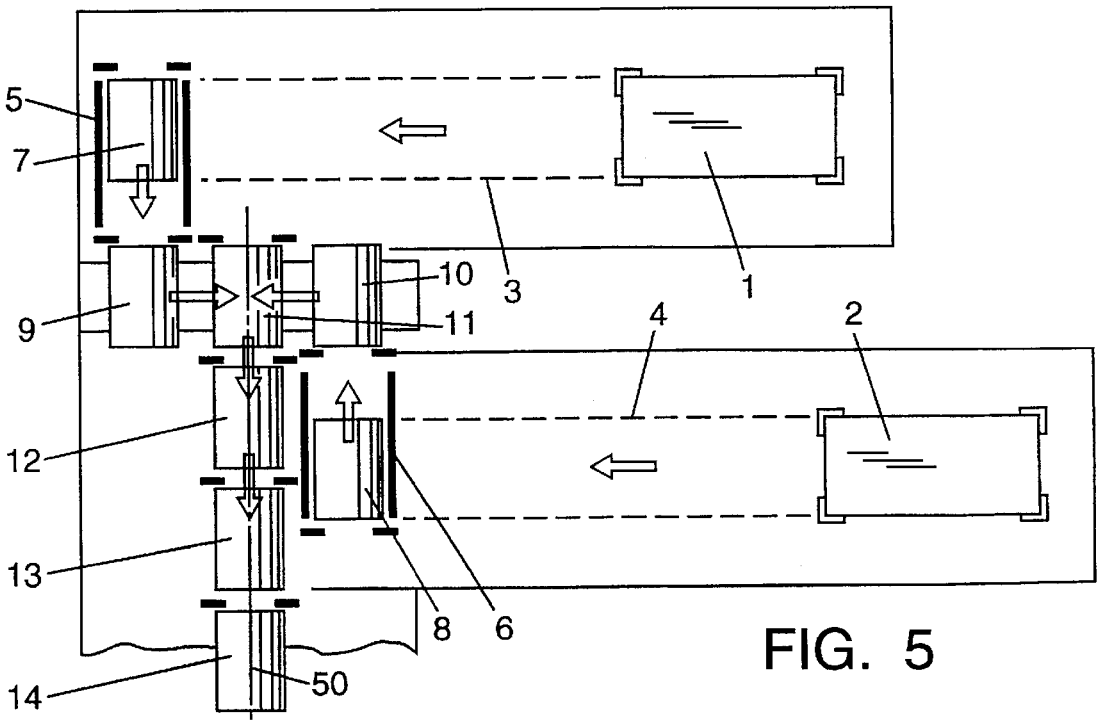
FIG. 5 illustrates another embodiment with two destacking tables.

FIG. 5 illustrates another embodiment, similar to that of FIG. 4. In this embodiment, however, the two can body forming stations 5,6 disposed respectively on opposite sides of the feed axis 50 convey the can bodies 7,8 respectively to the same conveying element for transverse displacement. This conveying element may again comprise a conveyor belt with compartments, which alternates its direction of travel depending on which can body 7,8 respectively has to be brought on to the feed axis 50.

Figure 6:
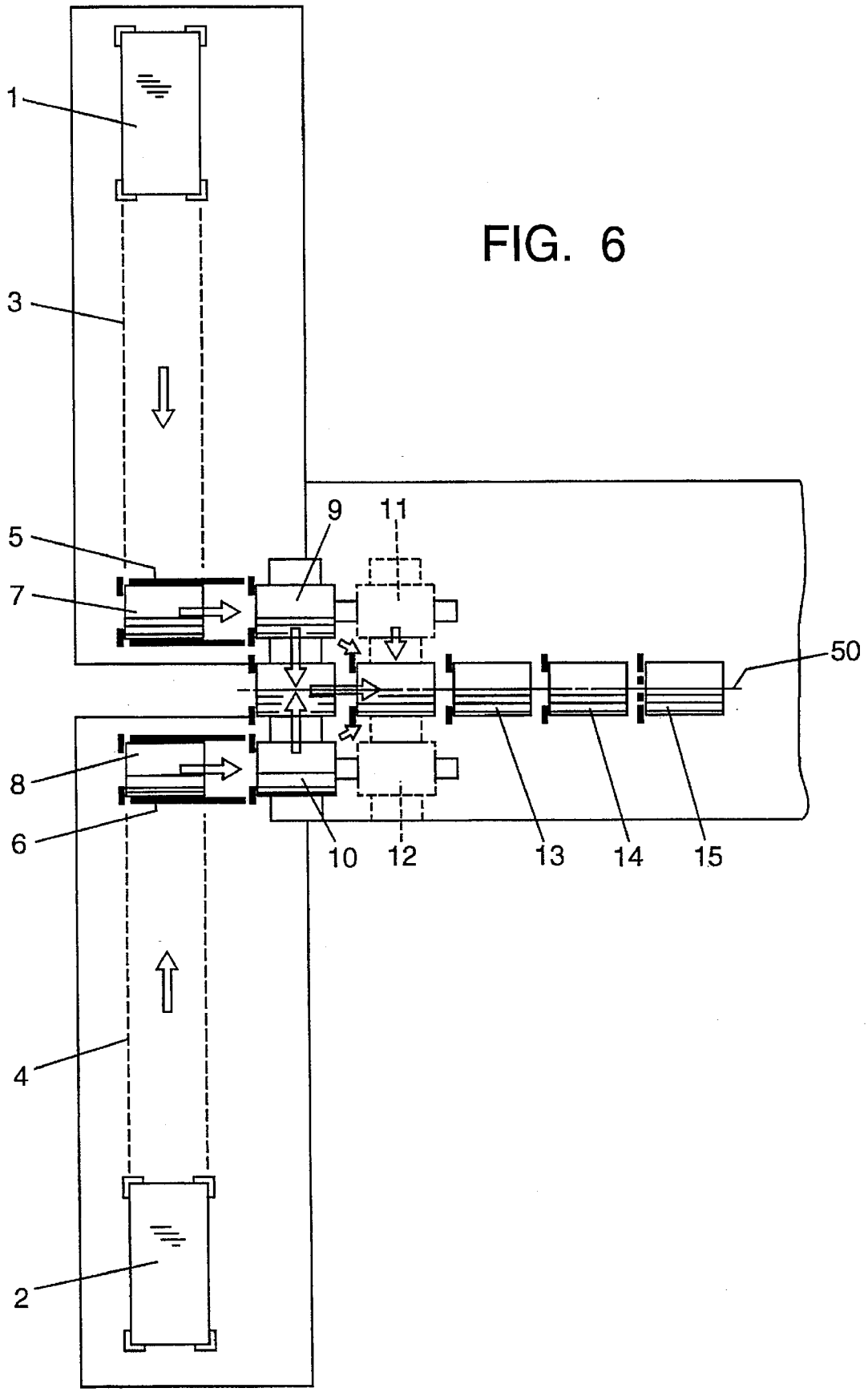
FIG. 6 illustrates an embodiment with destacking tables disposed on both sides of the feed axis.

FIG. 6 illustrates another embodiment, wherein the same reference numerals as employed previously denote the same elements. The formed can bodies are ejected parallel to the feed axis from the can body forming stations 5,6, which are situated here on both sides of but parallel to the feed axis 50, the ejection being effected each time by one or two positions in the direction of the feed axis. From these parallel locations the can bodies are then moved transversely to the feed axis. This can be effected alternately, so that the movement parallel to the feed axis does not have to be executed within a cycle of the doubled conveying stroke.

Figure 7:
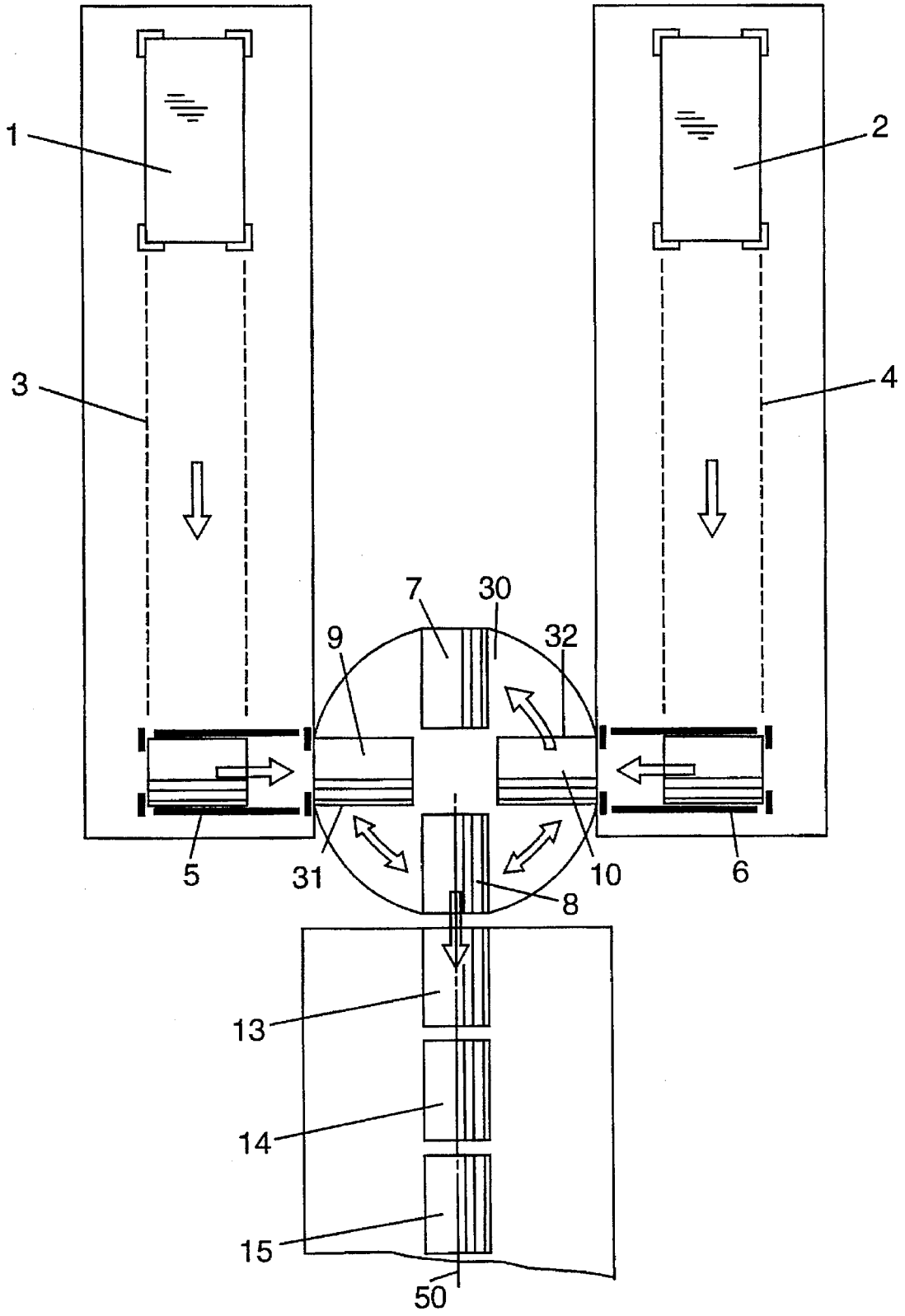
FIG. 7 illustrates an embodiment in which the formed can bodies are pivoted.

FIG. 7 illustrates another embodiment. The same reference numerals as before are used here to denote the same elements. Two can bodies are simultaneously conveyed each time on to a turntable 30 from the can body forming stations, which are situated transversely to the feed axis 50 here. The turntable 30 subsequently rotates the can bodies 7,8 to the feed axis 50. In this position of the turntable 30 its empty compartments 31,32 are again situated in front of the can body forming stations and can be occupied by fresh can bodies. At the same time the can bodies 7,8, which now lie on the feed axis, are conveyed further in the direction of the feed axis, the corresponding compartments of the turntable being emptied again. Thereafter the turntable executes a further movement through 90° and the operation is repeated.

Figure 8:
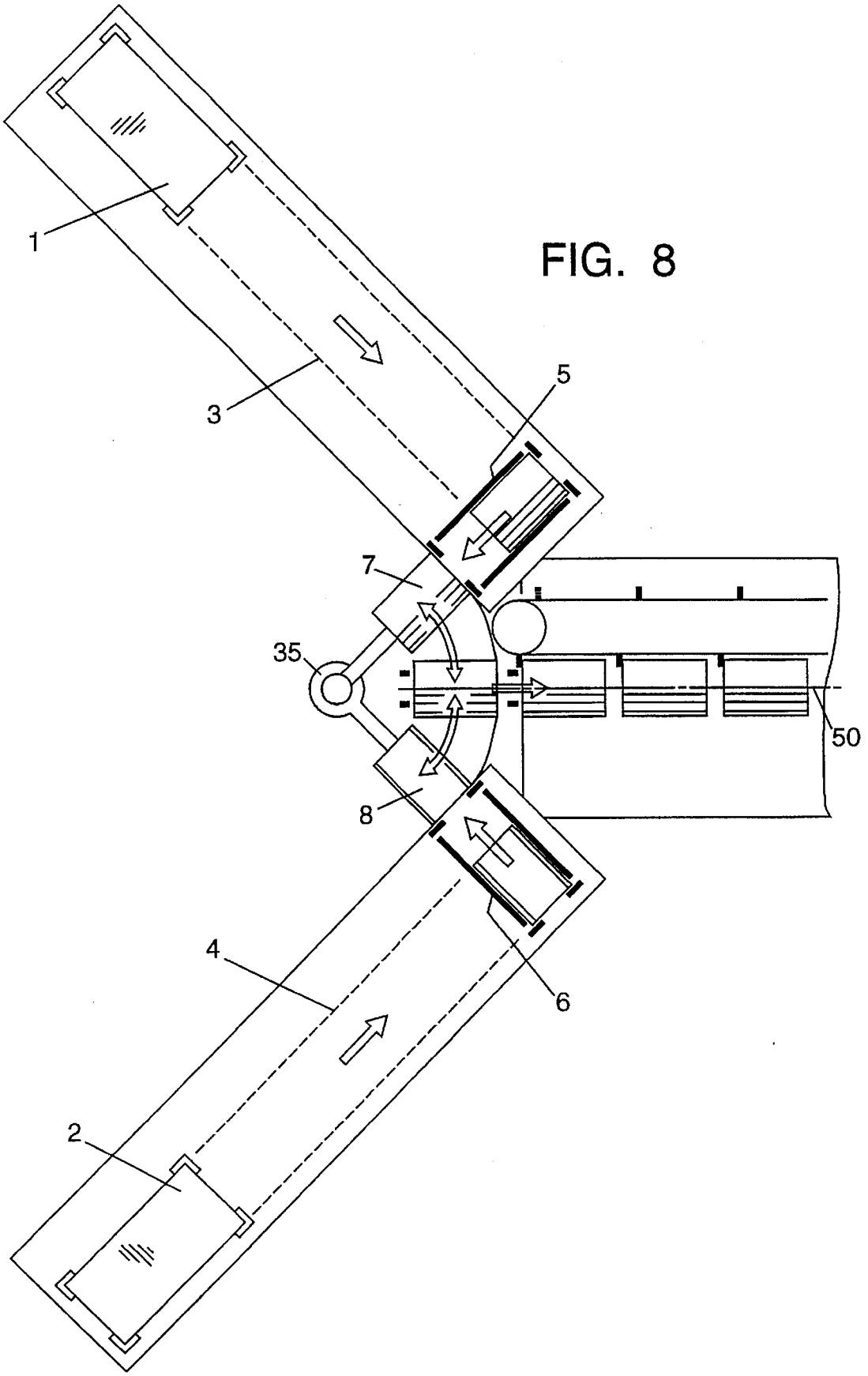
FIG. 8 illustrates another type of such an embodiment.

FIG. 8 illustrates another embodiment, wherein the same reference numerals as before denote the same elements. In this embodiment the can body forming stations are situated at an oblique angle to the feed axis 50. An oscillating table 35 with three receiving compartments pivots each of the can bodies 7,8 respectively to the feed axis.

Figure 9:
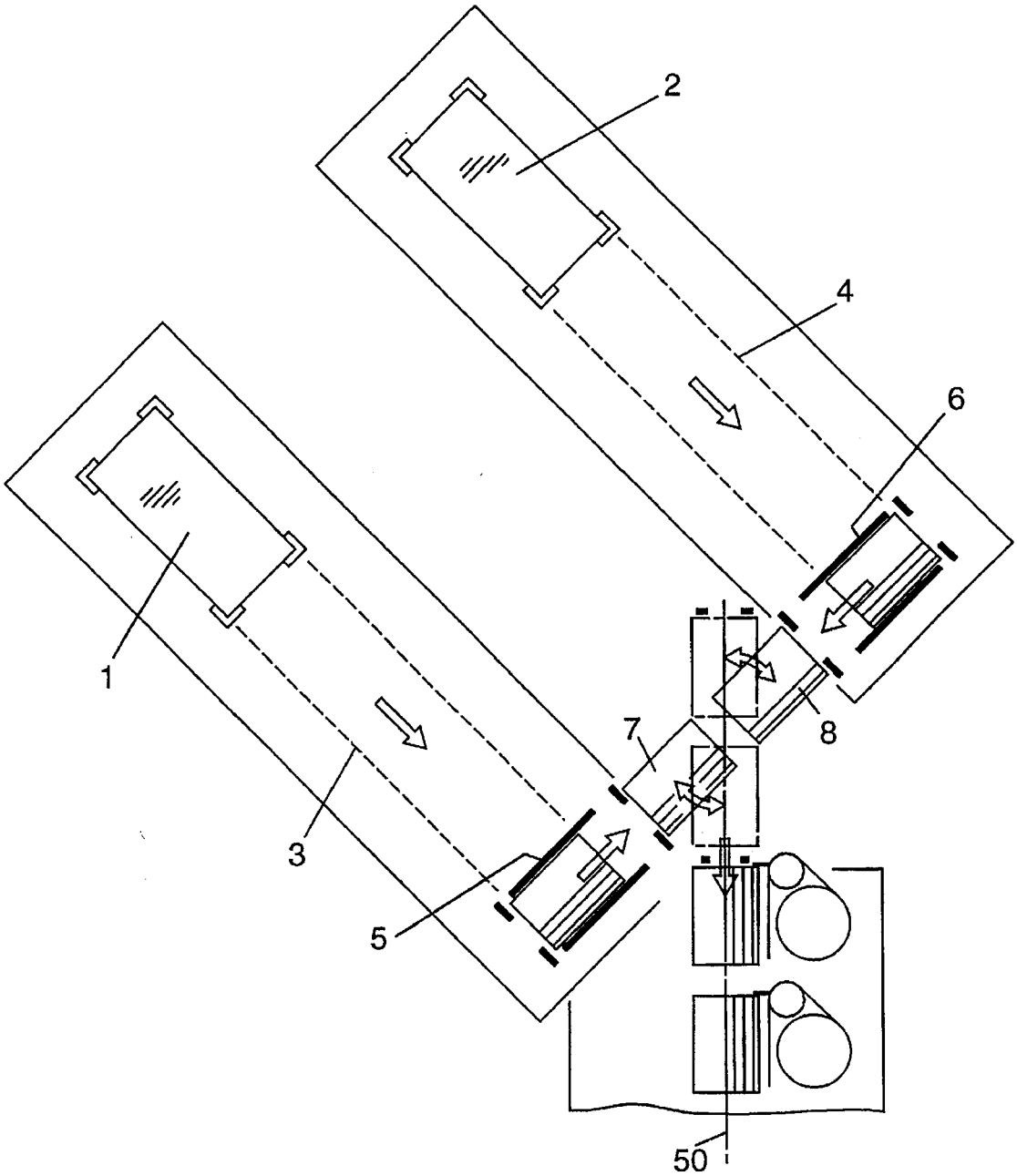
FIG. 9 also illustrates a type of embodiment with pivoting of the can bodies.

FIG. 9 illustrates another embodiment, wherein the same reference numerals as before denote the same elements. The two can body forming stations 5,6 are here situated on both sides of the feed axis 50. An oscillating table is provided, which receives two can bodies 7,8 each time and pivots them to the feed axis 50.

Figure 10:
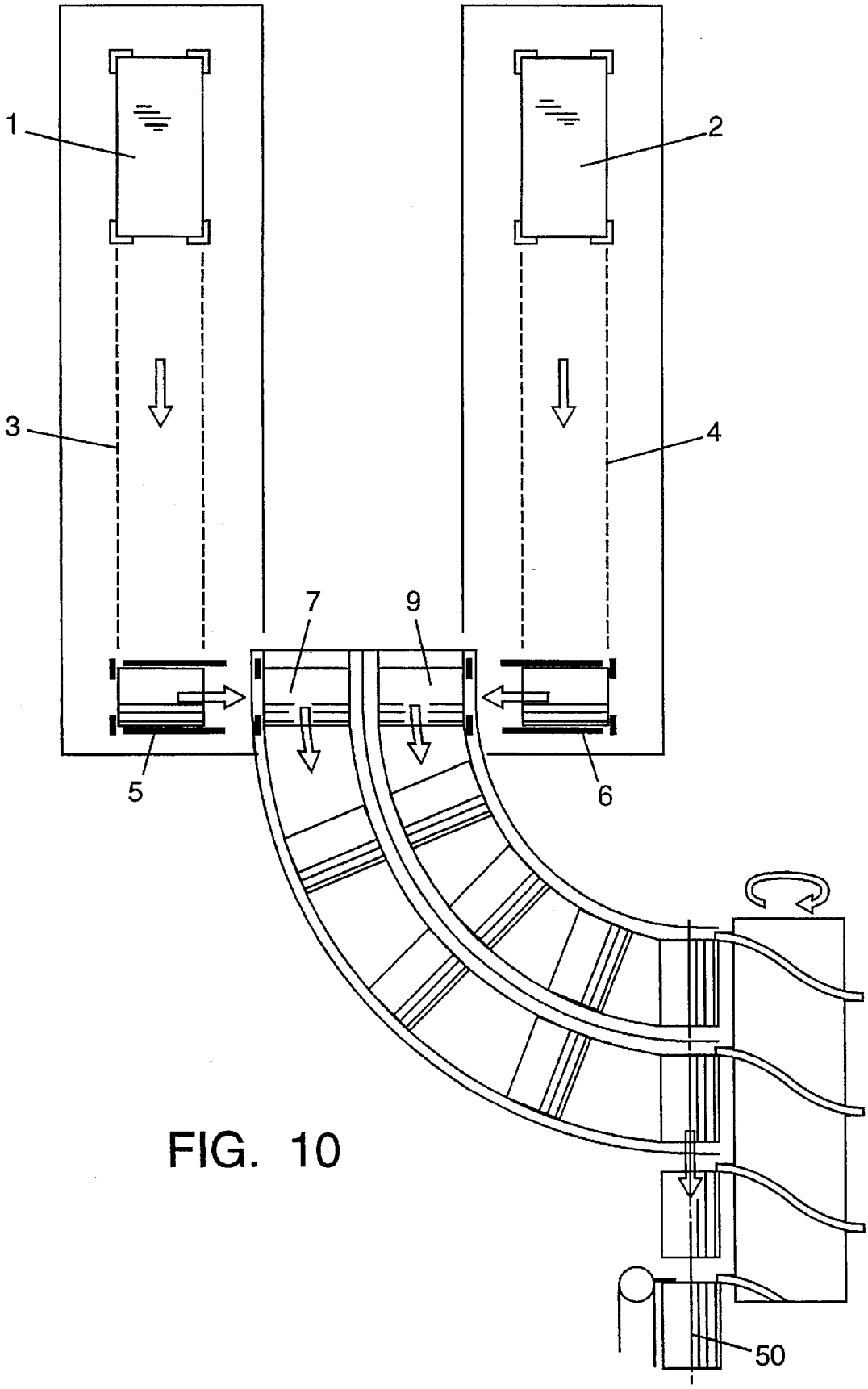
FIG. 10 illustrates a type of embodiment in which the can bodies are guided along a curved conveying path.

FIG. 10 illustrates another embodiment, in which the can bodies are taken along a curved conveying path to the feed axis 50. A conveying path is thus assigned to each can body forming station 5,6 respectively.

Figure 11:
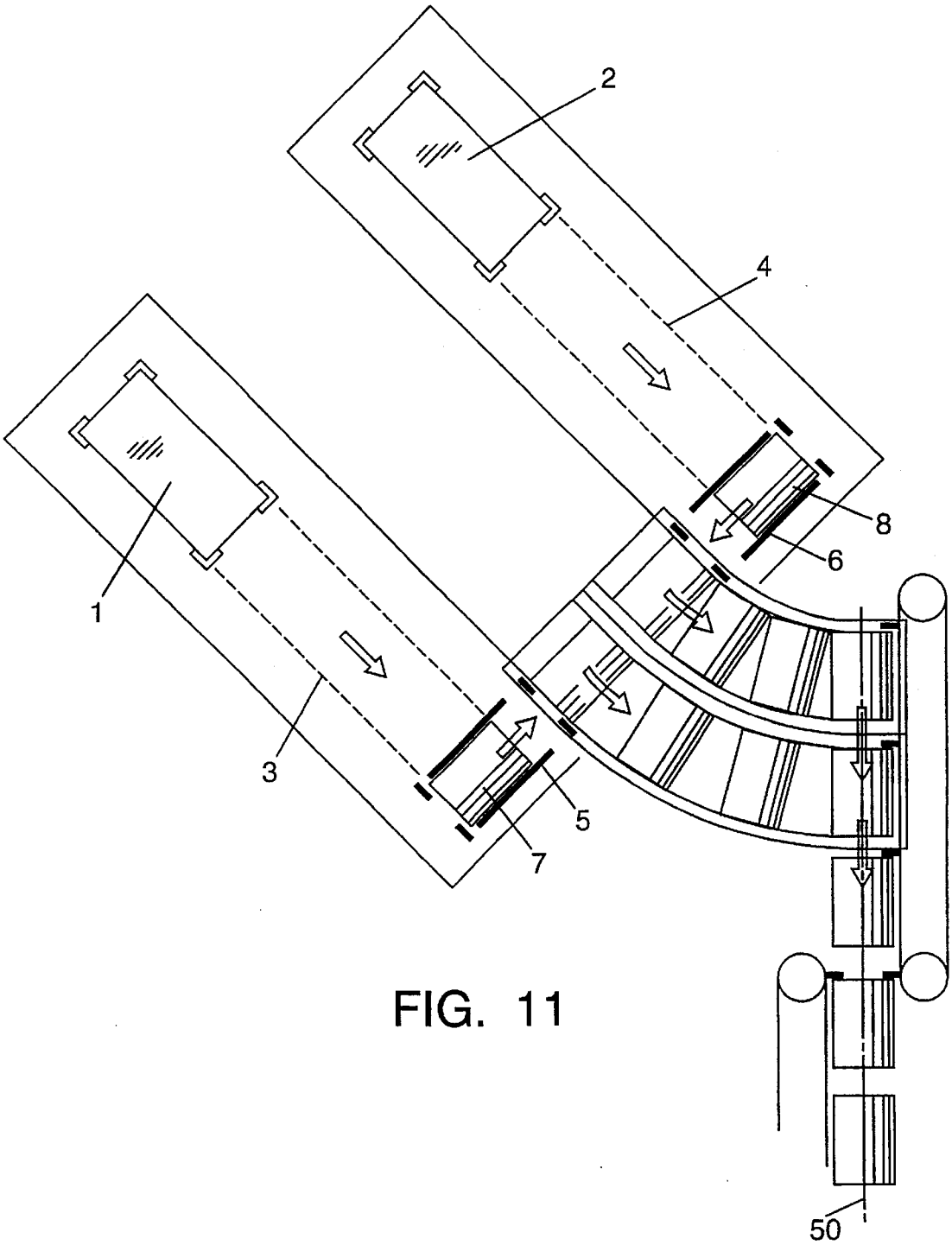
FIG. 11 illustrates another type of such an embodiment.

FIG. 11 illustrates an embodiment similar to that shown in FIG. 10, the can body forming stations here being situated at an oblique angle to the feed axis 50; this shortens the curved conveying path.

Figure 12:
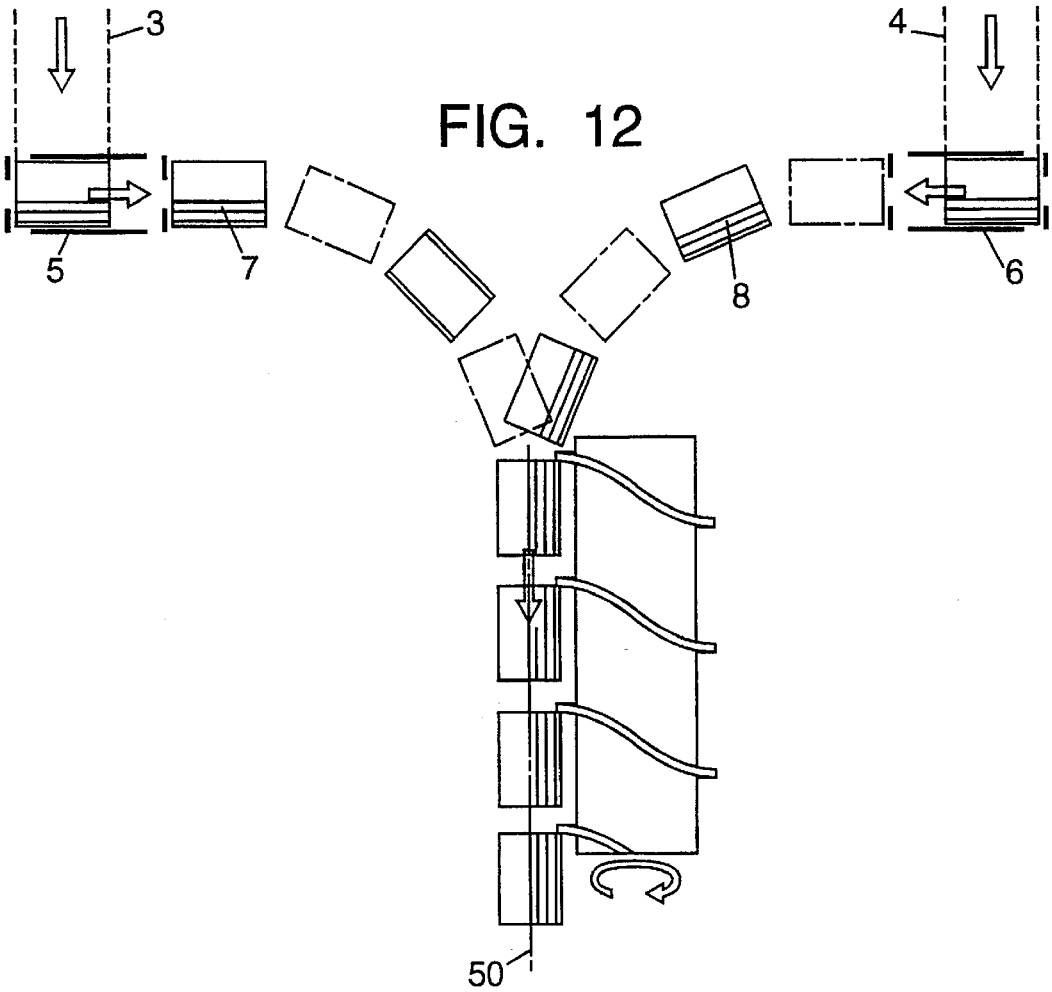
FIG. 12 illustrates another type of embodiment with a curved conveying path.

FIG. 12 also illustrates an embodiment with curved conveying paths for the formed can bodies, the can body forming stations 5,6 here being situated respectively on opposite sides of the feed axis 50, so that the curved conveying paths are not parallel.

Figure 13:
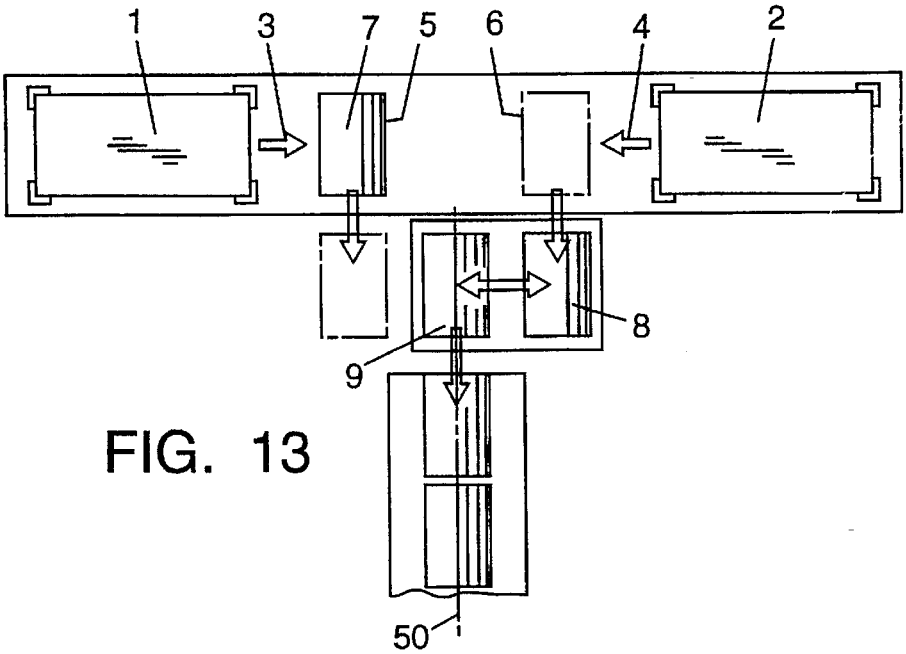
FIG. 13 illustrates a type of embodiment with a feed table which oscillates.

FIG. 13 also illustrates another embodiment in which a table with two compartments and which oscillates is provided downstream of the can body forming stations. By means of oscillatory movement, the table registers one compartment to the corresponding can body forming station and brings the other compartment on to the feed axis 50.

In all embodiments, the forming of the can bodies and the conveying of them may wholly or partially coincide each time, i.e. a conveying operation may also take place simultaneously during forming. In the embodiments with oscillating movements (see FIG. 7 and FIG. 8) a single oscillating drive may be provided in each case, or two independent oscillating drives may be provided, so that the oscillating conveying movements can take place mechanically independently of each other.

The two destacking units may operate synchronously or with phase-displacement, depending on the type and form of construction of the further conveying means for the can bodies. Forming may be carried out synchronously or asynchronously in the separate forming stations, in order to make optimum use of the time available, to produce rounded can bodies, or to coordinate with the onward conveying means.

We claim:

1. A process for forming metal sheets into can bodies and feeding the can bodies into a single can welding station, comprising the steps of:

destacking individual metal sheets from two separate stacks of metal sheets using two destacking stations, each destacking station being associated with a respective stack;

feeding the destacked metal sheets from the destacking stations to respective ones of two can body forming stations, each destacking station having an associated can body forming station;

forming individual metal sheets into can bodies at the can body forming stations; and sequentially transporting the can bodies in two arcuate paths from respective can body forming stations to a single feed path for a welding station using two arcuate conveyors.

2. A process according to claim 1, wherein the arcuate paths are concentric.

3. A process according to claim 1, wherein the metal sheets being formed into can bodies are moved in a direction at an oblique angle relative to the feed path during the step of forming.

4. A process according to claim 1, wherein the metal sheets being formed into can bodies are moved in a direction perpendicular to relative to the feed path during the step of forming.

5. A process according to claim 1, wherein the metal sheets being formed into can bodies are moved transversely to the feed path during the step of transporting.

6. An apparatus for forming metal sheets into can bodies and feeding the can bodies into a single can welding station comprising:

destacking stations for destacking individual metal sheets from two separate stacks of metal sheets, each destacking station being associated with a respective stack;

can body forming stations for forming individual metal sheets into can bodies, each can body forming station being associated with a respective destacking station;

means for feeding the destacked metal sheets from a destacking station to a respective one of two can body forming stations; and arcuate conveyors for sequentially transporting can bodies in two arcuate paths from the can body forming stations to a single feed path for a welding station.

7. An apparatus according to claim 6, wherein the arcuate paths are concentric.

8. An apparatus according to claim 6, wherein the metal sheets being formed into can bodies are moved in a direction at an oblique angle relative to the feed path during the step of forming.

9. An apparatus according to claim 8, wherein the angle is preferably about 45 degrees.

10. An apparatus according to claim 6, wherein the metal sheets being formed into can bodies are moved in a direction perpendicular to the feed path during the step of forming.

11. An apparatus according to claim 6, wherein the metal sheets being formed into can bodies are moved transversely to the feed path during the step of transporting.

12. An apparatus according to claim 6, wherein the can body forming stations are separated by a distance of greater than twice the width of a can body.

13. A process for forming metal sheets into can bodies and feeding the can bodies into a single can welding station, comprising the steps of:

destacking individual metal sheets from two separate stacks of metal sheets using two destacking stations, each destacking station being associated with a respective stack;

feeding the destacked metal sheets from a destacking station to a respective one of two can body forming stations, each destacking station having an associated can body forming station;

forming individual metal sheets into can bodies at the can body forming stations; and sequentially transporting the can bodies in arcuate paths from the can body forming stations to a single feed path for a welding station.

14. A process according to claim 13, wherein the can bodies are transported from opposite sides of the feed path into the feed path during the step of transporting.

15. A process according to claim 13, wherein the metal sheets being formed into can bodies are moved in a direction perpendicular to the feed path.

16. A process according to claim 13, wherein the metal sheets being formed into can bodies are moved transversely to the feed path during the step of transporting.

* * * * *